US009373287B2

(12) United States Patent
Margerm et al.

(10) Patent No.: US 9,373,287 B2
(45) Date of Patent: Jun. 21, 2016

(54) REDUCED POWER DISPLAYS

(75) Inventors: Steve Margerm, New Westminster (CA); Neil W. Messmer, Langley (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 65 days.

(21) Appl. No.: 13/384,868

(22) PCT Filed: Jul. 21, 2010

(86) PCT No.: PCT/US2010/042798

§ 371 (c)(1), (2), (4) Date: Jan. 19, 2012

(87) PCT Pub. No.: WO2011/011548

PCT Pub. Date: Jan. 27, 2011

(65) Prior Publication Data

US 2012/0113167 A1 May 10, 2012

Related U.S. Application Data

(60) Provisional application No. 61/228,156, filed on Jul. 23, 2009, provisional application No. 61/234,148, filed on Aug. 14, 2009.

(51) Int. Cl.
*G09G 5/10* (2006.01)
*G09G 3/34* (2006.01)

(52) U.S. Cl.
CPC ..... *G09G 3/3426* (2013.01); *G09G 2310/066* (2013.01); *G09G 2320/064* (2013.01); *G09G 2320/0646* (2013.01); *G09G 2330/021* (2013.01); *G09G 2330/025* (2013.01); *G09G 2360/16* (2013.01)

(58) Field of Classification Search
USPC ..... 345/102, 211, 690; 315/312
See application file for complete search history.

(56) References Cited

U.S. PATENT DOCUMENTS

| | | | | |
|---|---|---|---|---|
| 6,573,928 | B1 * | 6/2003 | Jones et al. | 348/51 |
| 6,891,672 | B2 | 5/2005 | Whitehead | |
| 7,312,782 | B2 | 12/2007 | Hiraki | |
| 7,385,583 | B2 | 6/2008 | Kim | |
| 7,403,332 | B2 | 7/2008 | Whitehead | |
| 2004/0001040 | A1 | 1/2004 | Kardach | |
| 2007/0262732 | A1 * | 11/2007 | Shen | 315/312 |
| 2007/0262948 | A1 | 11/2007 | Han | |
| 2007/0296686 | A1 | 12/2007 | Yoo | |

(Continued)

FOREIGN PATENT DOCUMENTS

| | | |
|---|---|---|
| CN | 101409058 | 4/2009 |

*Primary Examiner* — Jason Olson
*Assistant Examiner* — Sosina Abebe

(57) ABSTRACT

A backlight for a display comprises a plurality of independently controllable groups of light emitters. The brightness levels of the groups of light emitters are controllable by pulse width modulation (PWM) signals generated by PWM driving circuits. The phases of PWM signals to different groups of light emitters are configured to be offset by different amounts, so as to stagger the start times of light emitters of different groups. Such phase-shifting of PWM signals may result in total power consumption that ramps up more gradually, is distributed more evenly over time, and is held to a lower maximum value than if the same PWM signals were not phase-shifted. The duration of a first PWM cycle of PWM signals for an image may also be made longer than subsequent PWM cycles for the image so as to extend the initial power ramp-up time.

19 Claims, 10 Drawing Sheets

(56) References Cited

U.S. PATENT DOCUMENTS

| | | | | |
|---|---|---|---|---|
| 2008/0068329 | A1* | 3/2008 | Shestak et al. | 345/102 |
| 2008/0129714 | A1 | 6/2008 | Akiyama | |
| 2008/0180466 | A1 | 7/2008 | Whitehead | |
| 2008/0258639 | A1 | 10/2008 | Kim | |
| 2008/0278097 | A1* | 11/2008 | Roberts et al. | 315/294 |
| 2009/0021470 | A1 | 1/2009 | Lee | |
| 2009/0122087 | A1* | 5/2009 | Maruyama et al. | 345/690 |
| 2009/0295706 | A1* | 12/2009 | Feng | G09G 3/342 345/102 |
| 2010/0007577 | A1* | 1/2010 | Ninan et al. | 345/1.3 |

* cited by examiner

REDUCED POWER DISPLAYS

CROSS-REFERENCE TO RELATED APPLICATIONS

This application claims priority to U.S. Provisional Patent Application Nos. 61/228,156 filed 23 Jul. 2009 and 61/234,148 filed 14 Aug. 2009, hereby incorporated by reference in its entirety.

TECHNICAL FIELD

This invention relates generally to displays, such as LCD panel displays for example. The invention relates to displays of the type that have backlights comprising an array of light emitting devices, such as light emitting diodes (LEDs), and to backlights suitable for application in such displays.

BACKGROUND

Some displays, such as liquid crystal displays (LCDs), comprise a spatial light modulator that is illuminated by a backlight. Light from the backlight interacts with the spatial light modulator which spatially modulates the light so as to present images to a viewer. The images may be still images or video images for example. The spatial light modulator may comprise an array of controllable pixels.

In some such displays, the backlight includes multiple light emitting devices, such as LEDs, for illuminating regions of the spatial light modulator. Such light emitting devices or groups of such light emitting devices may be separately controllable so that the intensity of light emitted by the backlight can be made to vary in a desired way over the spatial light modulator. Such displays are referred to herein as dual-modulation displays. Some examples of dual modulation displays are described in: U.S. Pat. No. 6,891,672 issued 10 May 2005 and entitled "High Dynamic Range Display Devices", U.S. Pat. No. 7,403,332 issued 22 Jul. 2008 and entitled "High Dynamic Range Display Devices", and United States Patent Application Publication No. 2008/0180466 published 31 Jul. 2008 and entitled "Rapid Image Rendering on Dual-Modulator Displays", all of which are hereby incorporated herein by reference for all purposes.

The brightness of light emitters on a backlight may be controlled by a technique known as pulse width modulation (PWM). A light emitting device such as an LED may be switched between an ON state at 100% brightness and an OFF state at 0% brightness by switching on and off a suitable fixed electrical current through the device. PWM operates by pulsing each light emitter to its ON state for some percentage of a repeating time period. If the time period is sufficiently short (e.g. 1 millisecond) the human visual system does not detect the light emitter cycling between ON and OFF states. An observer merely perceives the average emitted light intensity, which is proportional to the percentage of the PWM period that the device is in the ON state. This percentage is referred to as the duty cycle of the PWM signal. For example, a light emitter driven by a PWM signal with a duty cycle of 75% is switched on for 75% of each PWM period and appears to an observer as if it were steadily emitting light having a brightness of 75% of its maximum brightness.

SUMMARY

This invention has a number of aspects. One provides displays. The displays may comprise, for example, computer displays, televisions, video monitors, home cinema displays, stadium displays, specialized displays such as displays for medical images, displays in vehicle simulators or virtual reality systems, or the like. Another aspect of the invention provides backlights for displays. Another aspect of the invention comprises controllers and control devices useful for controlling backlights for displays. Other aspects of the invention provide methods for operating displays and methods for driving display backlights.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1A:
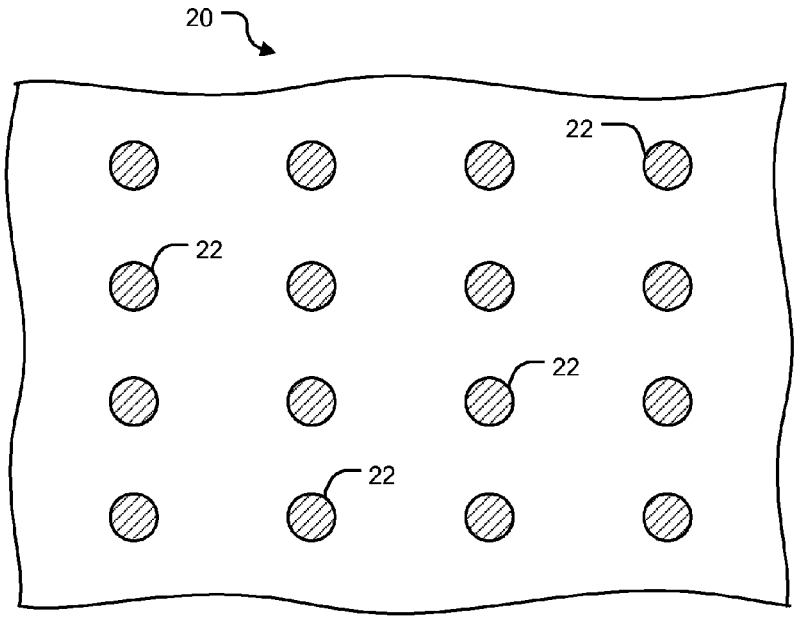
FIG. 1A PRIOR ART
FIG. 1A is a schematic plan view of a prior art backlight for a display.

FIG. 1A illustrates a backlight 20 for a display. Backlight 20 comprises a plurality of light emitters 22. Light emitters 22 may be LEDs for example. The emitted light may comprise broadband light such as white light or comprise a mixture of light having different spectra. For example, backlight 20 may comprise separate red, green and blue light emitters. As mentioned above, in the case of dual modulation displays backlight 20 may comprise an array of individually-controllable light sources (e.g. LEDs) to illuminate the back of a spatial light modulator. Each individually-controllable light source may comprise one or more light-emitting devices.

Figure 1B:
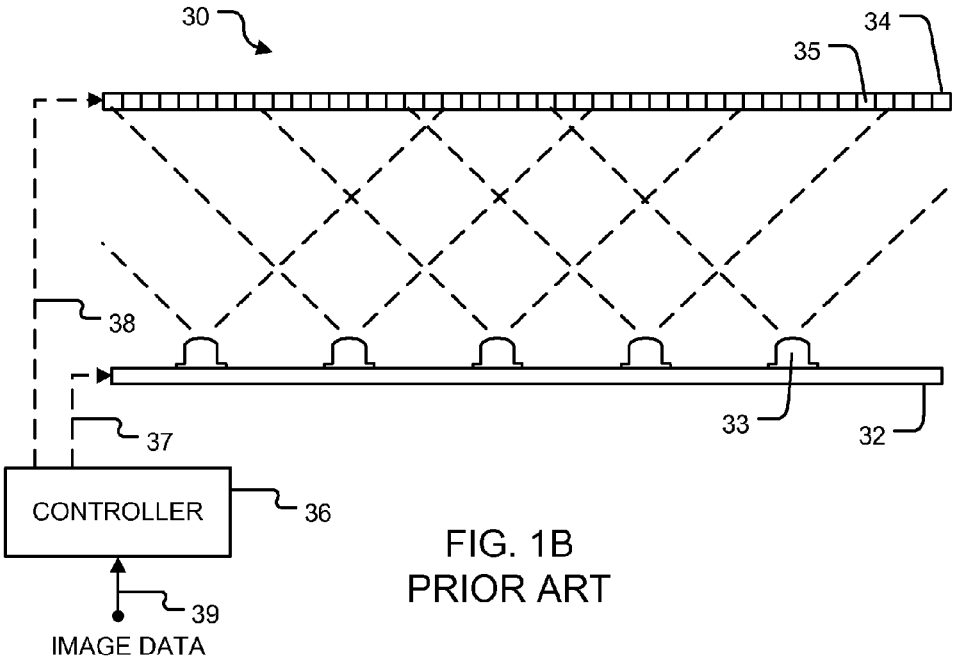
FIG. 1B PRIOR ART
FIG. 1B illustrates a backlight like that of FIG. 1A illuminating a spatial light modulator.

FIG. 1B shows a display 30. Display 30 has a backlight 32 which illuminates a spatial light modulator 34. Backlight 32 comprises a plurality of light emitters 33. Spatial light modulator 34 comprises an array of pixels 35 which can be controlled to pass varying amounts of the light incident on them to a viewing area. In the illustrated display, the spatial light modulator is of a transmissive type. Spatial light modulator 34 may comprise an LCD panel, for example.

Display 30 comprises a controller 36 that generates control signals 37 that control light emitters 33 of backlight 32 to emit light having an intensity that varies spatially over the area of spatial light modulator 34. Controller 36 also generates control signals 38 that control the pixels 35 of spatial light modulator 34. Controller 36 receives image data at an input 39 and, based on the image data, generates control signals 37 and 38 to cause a viewer to see images according to the image data.

Figure 2:
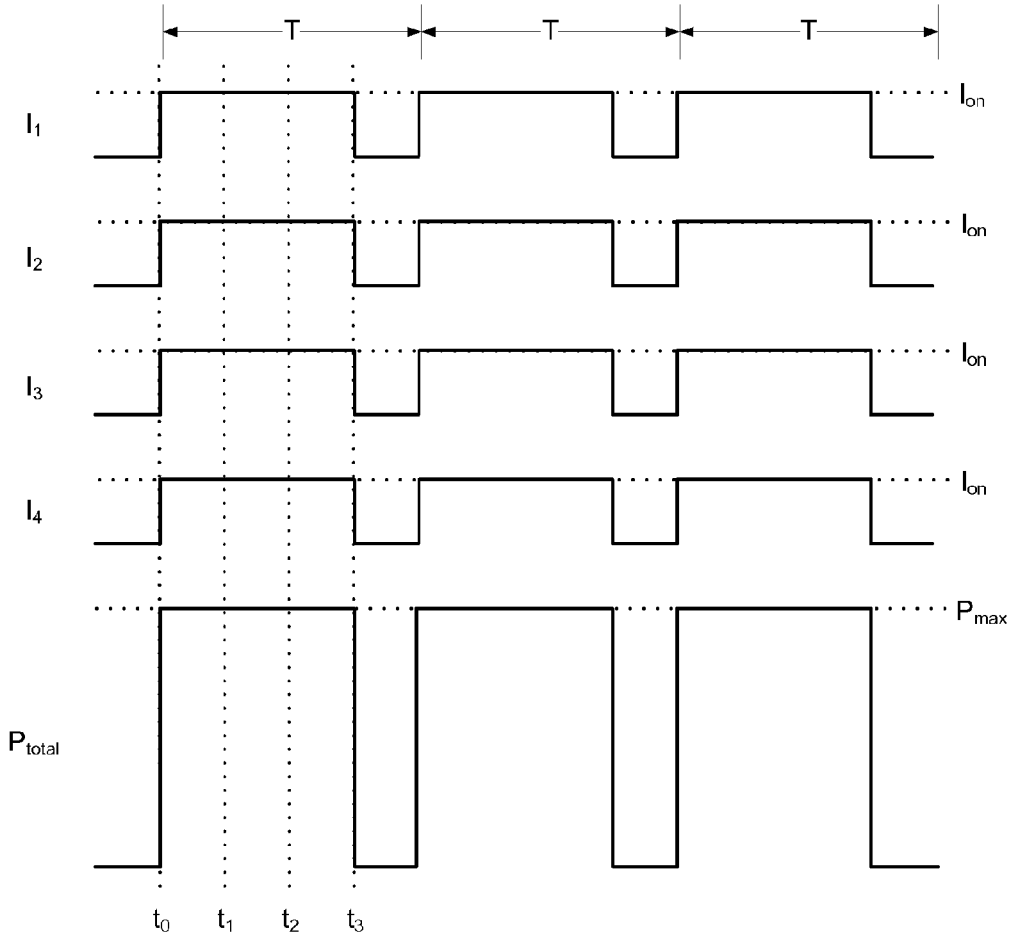
FIG. 2 PRIOR ART
FIG. 2 is a waveform diagram illustrating the power required by four conventional PWM driving signals having the same phase.

FIG. 2 illustrates four PWM driving signals $I_1$-$I_4$ for driving four light emitters or groups of light emitters on a backlight. The PWM signals $I_1$-$I_{4i}$ each have a period T and an on-time or duty cycle of 75% of T. All of the signals are in phase with each other. They each rise together by a current $I_{on}$ at time $t_0$ and fall together at time $t_3$. Current $I_{on}$ corresponds to the current required to drive the light emitters in their ON state. PWM driving signals $I_1$-$I_4$ are depicted as identical in FIG. 2 for ease of illustration; however, in a dual modulation display each signal may be individually-controllable to have a specific duty cycles. Thus different light emitters 33 may operate at different brightness levels. In typical PWM as illustrated in FIG. 2, brightness levels are controlled by varying the time at which each light emitter is switched off within a PWM cycle; that is, the duty cycle is timed from the start of each PWM cycle.

The waveform $P_{total}$ in FIG. 2 represents total electrical power required to drive the light emitters controlled by the four PWM driving signals $I_1$-$I_4$. Total power $P_{total}$ is the sum of the power consumed by each such light emitter at a given time, as given by P=I V where I is the driving current through the light emitter and V is the corresponding voltage drop across the light emitter at that time. As seen in FIG. 2, $P_{total}$ jumps immediately to a maximum value, $P_{max}$, at time $t_0$. For example, if each PWM signal $I_1$-$I_4$ drove a light emitter consuming power of $(I_{on})$ $(V_{on})$ when in an ON state, $P_{max}$ would equal $4(I_{on})(V_{on})$. $P_{total}$ remains at $P_{max}$ from times $t_0$ to $t_3$ and then drop to zero for the final quarter of each PWM cycle as every light emitter switches to the OFF state. Similarly, the four LEDs would draw a total current of $4(I_{on})$ from times $t_0$ to $t_3$ and then draw zero total current for the final quarter of each cycle.

A drawback to PWM when used with multiple light emitters is that the light emitters are all turned on simultaneously for some duration during the beginning of each PWM cycle (for any non-zero brightness setting). The result is that the power supply for the display must be able to deliver enough power to fully drive all of the light emitters for at least a short time and to provide this power almost instantaneously, regardless of the display's effective brightness level. This requirement increases the cost and complexity of the display's power supply, particularly for backlights having large numbers of light emitters. Some backlights may have dozens, hundreds or thousands of individual light emitters. This problem is particularly acute in the case that the display has the capability of displaying very bright images as is the case, for example, in some high dynamic range (HDR) displays. Such displays may be capable of displaying images having local light intensities of $2000^{cd}/m^2$ or more. In such displays, light emitting elements may be of types that consume significant electrical power in their ON states. This invention may be applied to such displays as well as to other displays.

In some embodiments, such transient power requirements are reduced by dividing the light emitters of a backlight into several groups and staggering the start times of PWM cycles for different ones of the groups over time. The light emitters can be divided into groups in any convenient manner.

Figure 3:
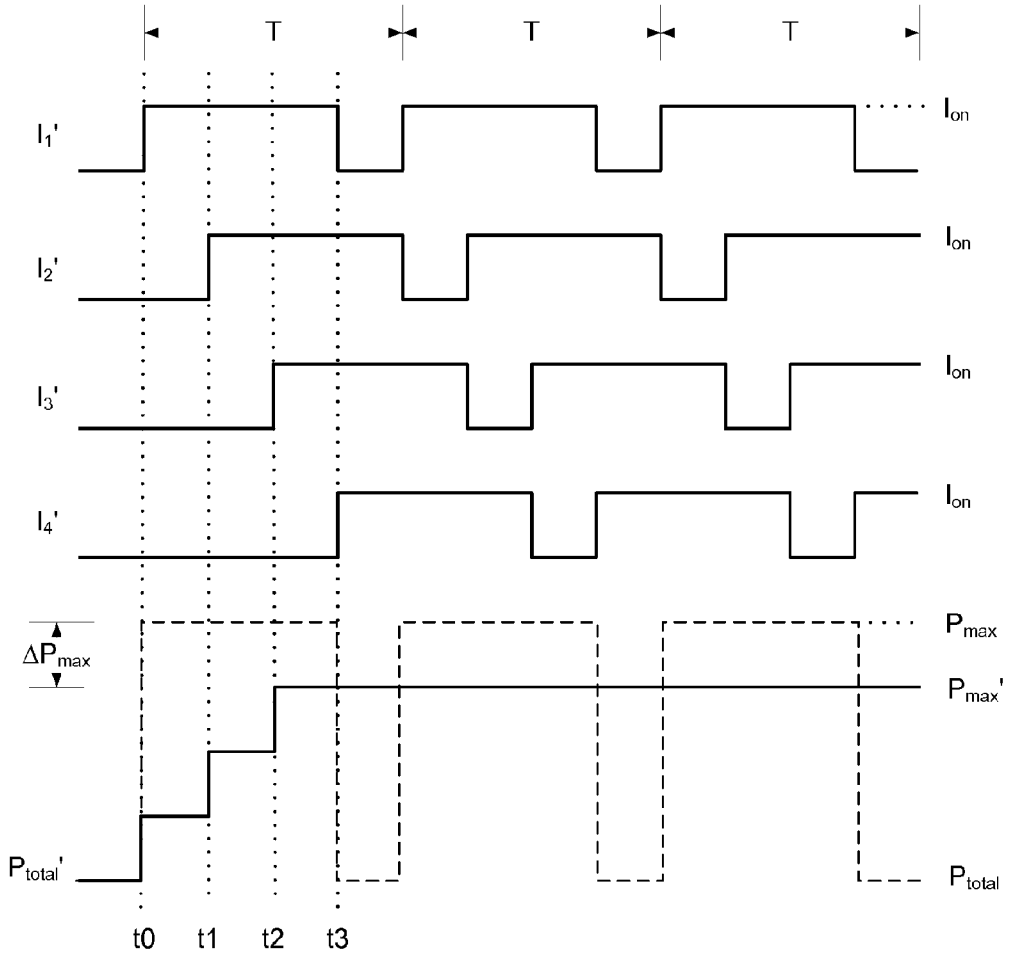
FIG. 3 is a waveform diagram illustrating the power required by four PWM driving signals having different phases according to an example embodiment of the present invention.

FIG. 3 illustrates PWM driving signals $I_1'$-$I_4'$ according to an example embodiment in which the light emitters of a backlight have been divided into four groups. Each group of light emitters is controlled by one of PWM signals $I_1'$-$I_4'$. As in FIG. 2, each PWM signal has a duty cycle of 75% so that the light emitters operate at an effective brightness of 75%. However, in contrast to FIG. 2, PWM signals $I_1'$-$I_4'$ in FIG. 3 are 90 out of phase with one another. As can be seen, by staggering the starting point of each group's PWM cycle the total power $P_{total}'$ required by the four groups of light emitters ramps up in steps at times $t_0$, $t_1$ and $t_2$ during the first PWM cycle to a maximum value $P_{max}'$. Total power $P_{total}'$ then remains constant at maximum value $P_{max}'$ during subsequent PWM cycles as shown.

The waveform $P_{total}$ of FIG. 2 is shown in a dotted line overlaying $P_{total}'$ in FIG. 3 to more easily see the differences in power requirements. As may be seen, the repeated power surges of $P_{total}$ associated with all light emitters switching on simultaneously at the start of each PWM cycle are avoided in $P_{total}'$. Rather, $P_{total}'$ ramps up in steps over the first PWM cycle to a level $P_{max}'$ at which it remains until the PWM signals are changed to display a subsequent image. As well as avoiding or reducing power surges, staggering start times of light emitters may result in a lower maximum power requirement for a given set of driving signals. In the illustrated embodiment $P_{max}'$ is less than $P_{max}$ by an amount $\Delta P_{max}$.

For example, assuming for the sake of simplicity that each PWM signal $I_1'$-$I_4'$ drives a light emitter consuming power of $(I_{on})$ $(V_{on})$ when in an ON state, $P_{total}'$ step ups incrementally by $(I_{on})$ $(V_{on})$ at times $t_0$, $t_1$ and $t_2$ to a maximum $P_{max}'$ of $3(I_{on})(V_{on})$. Thus the maximum power $P_{max}'$ is 75% of the equivalent maximum power $P_{max}$ of $4(I_{on})(V_{on})$ required when the PWM signals are in phase as illustrated in FIG. 2.

This concept may be extended to provide embodiments having any number of groups of light emitters having any suitable relative phase shift between their PWM signals. For example, in some embodiments light emitters are divided into N groups wherein PWM signals of each group are phase-shifted by 360/N relative to one another. The power requirements of a backlight will vary depending on a number of factors including the number of light emitters and the duty cycles and phase offsets of the PWM signals applied to each light emitter. The duty cycles (and hence the brightness levels) of the light emitters may be independently controllable as mentioned above. In some embodiments, advantages obtained by phase-shifting PWM signals may include the advantage that total power ramps up more gradually, is distributed more evenly and is held to a lower maximum value than if the same PWM signals were applied in phase.

PWM signals for a given image may cycle without change for as long as that image is being displayed. When a new image is displayed, the PWM driving signals may be updated to reflect image data for the new image. During the first PWM cycle of each new image, the total power may be required to ramp up from zero to a maximum value determined by the updated PWM signals. As described above, this initial ramp-up time may be extended by configuring groups of PWM signals to be out of phase with one another. During subsequent PWM cycles of the same image the total power may remain constant at this maximum value (as in the example illustrated in FIG. 3) or fluctuate to some degree relative to the initial ramp-up of the first PWM cycle.

For video images, image data and corresponding PWM driving signals may be updated at the start of each video frame. The PWM period may be much shorter than the video frame period such that multiple PWM cycles occur within a single video frame. For example, in some embodiments video frame periods are in the range of 3 to 16.7 milliseconds while PWM periods are in the range of 0.1 to 2 milliseconds.

Figure 4A:
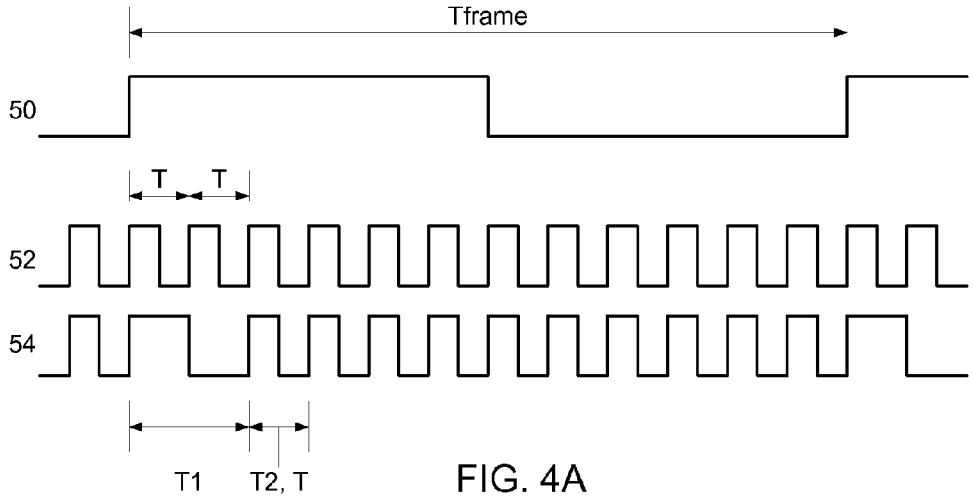
FIG. 4A is a waveform diagram illustrating the duration of a frame cycle relative to PWM cycles of a display according to an example embodiment of the present invention.

Example waveforms representing frame periods and PWM periods are illustrated in FIG. 4A. Waveform 50 represents example video frame cycles having a period of $T_{frame}$. Waveform 52 represents example PWM cycles having a period T. In this non-limiting example, each frame cycle of waveform 50 contains twelve PWM cycles of waveform 52.

According to another embodiment, the duration of the first PWM cycle after an image update is extended in time relative to subsequent PWM cycle periods of the same image. The image may be a video frame or a still image. Since power fluctuation or surges tend to be greatest during the first PWM cycle (as power ramps up from zero to a maximum value as illustrated in FIG. 3), lengthening the first PWM cycle allows more time for this initial power ramp-up to occur and reduces the power surge demands on the power supply accordingly. If only the first PWM cycle after an image update is extended (but still kept short relative to a frame period), there should be no visible effect on the light emitter brightness. The first PWM cycle period after an update may be extended in time up to about 2 milliseconds for example.

Waveform 54 of FIG. 4A is similar to waveform 52 except that the first PWM cycle of each frame cycle has a duration T1 that is longer than a period T2 of the subsequent PWM cycles within the frame cycle according to an example embodiment of the invention. Period T1 may be made any suitable amount longer than period T2. In some embodiments, period T1 is an integer multiple of period T2. In some embodiments the ratio of T1/T2 is in the range of 1.5 to 10 for example. In the illustrated embodiment, by way of non-limiting example, period T1 is twice as long as period T2 (where T2 is equivalent to period T of waveform 52).

Figure 4B:
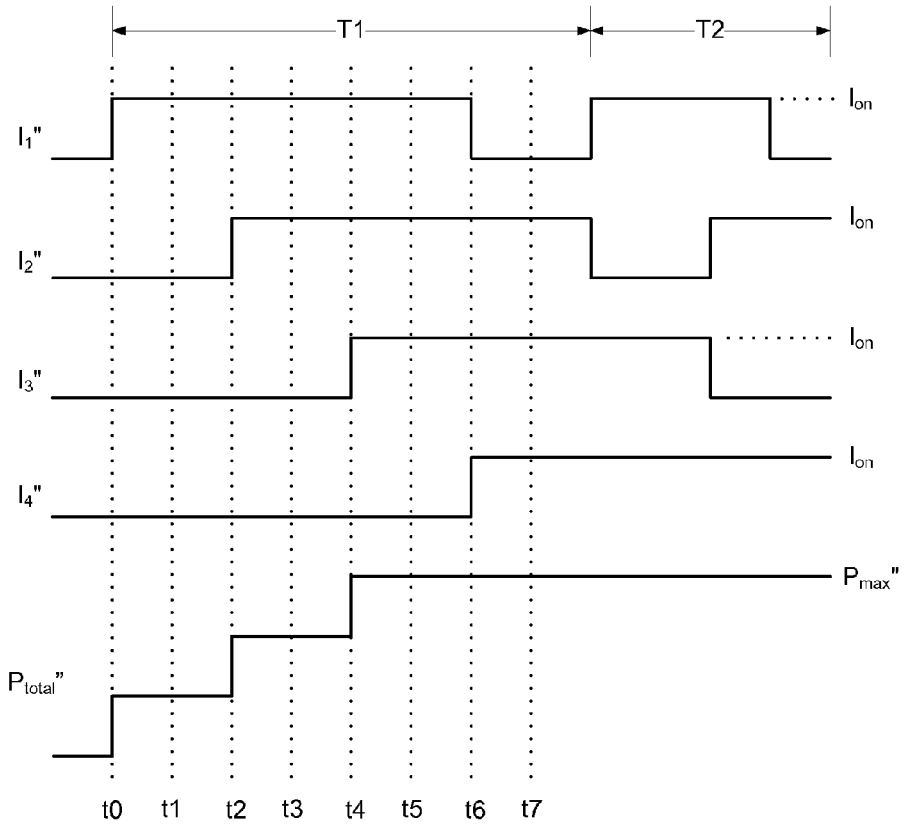
FIG. 4B is a waveform diagram illustrating PWM driving signals like those of FIG. 3 wherein the duration of the first PWM cycle in a frame is extended according to an example embodiment of the present invention.

FIG. 4B illustrates an example embodiment combining the phase shifting illustrated in FIG. 3 and the lengthened PWM cycle illustrated in FIG. 4A. In FIG. 4B, the duration of the first PWM cycle of signals $I_1''$-$I_4''$ is twice as long as the subsequent PWM cycles. The PWM signals $I_1''$-$I_4''$ in FIG. 4B are otherwise the same as $I_1'$-$I_4'$ shown in FIG. 3. As can be seen, the total power $P_{total}''$ steps up from zero to a maximum value $P_{max}''$ (equal to $P_{max}'$ in FIG. 3) at times $t_0$, $t_2$ and $t_4$ of the first PWM cycle. The initial power ramp-up time is thus doubled relative to the embodiment of FIG. 3.

Decreasing the ramp-up rate, magnitude and frequency of power variations of a backlight as described above may in turn decrease the complexity and cost of the power supply needed to power the backlight. For example, various parameters of a power supply such as surge capacity, load regulation and transient response may be eased where PWM signals are offset as illustrated in FIGS. 3 and 4. Surge capacity is a measure of the maximum current that a power supply is capable of supplying over a given period at a given duty cycle. The surge capacity of a power supply may be significantly greater than its average output power capacity. Load regulation is a measure of the ability of the power supply to maintain a constant output voltage in response to variations in the output load. Transient response is a measure of the time it takes for the output voltage to settle to a steady output voltage after an output load change. By moderating variations in output current required by the power supply, backlights according to embodiments of the present invention allow for power supplies having more moderate surge capacity, load regulation, and/or transient response. Also, reducing the surge currents delivered to the backlight may permit use of a power supply without complicated surge protection circuits.

Furthermore, the efficiency and reliability of the power supply may be increased where PWM signals are offset as illustrated in FIGS. 3 and 4. Power supplies tend to be more efficient when they are operated to supply a relatively consistent current and less efficient when bouncing between full and light loading. Similarly, electrical components of the power supply tend to be stressed less and last longer when the current drawn from the power supply is not bouncing between full and light loading.

Figure 5:
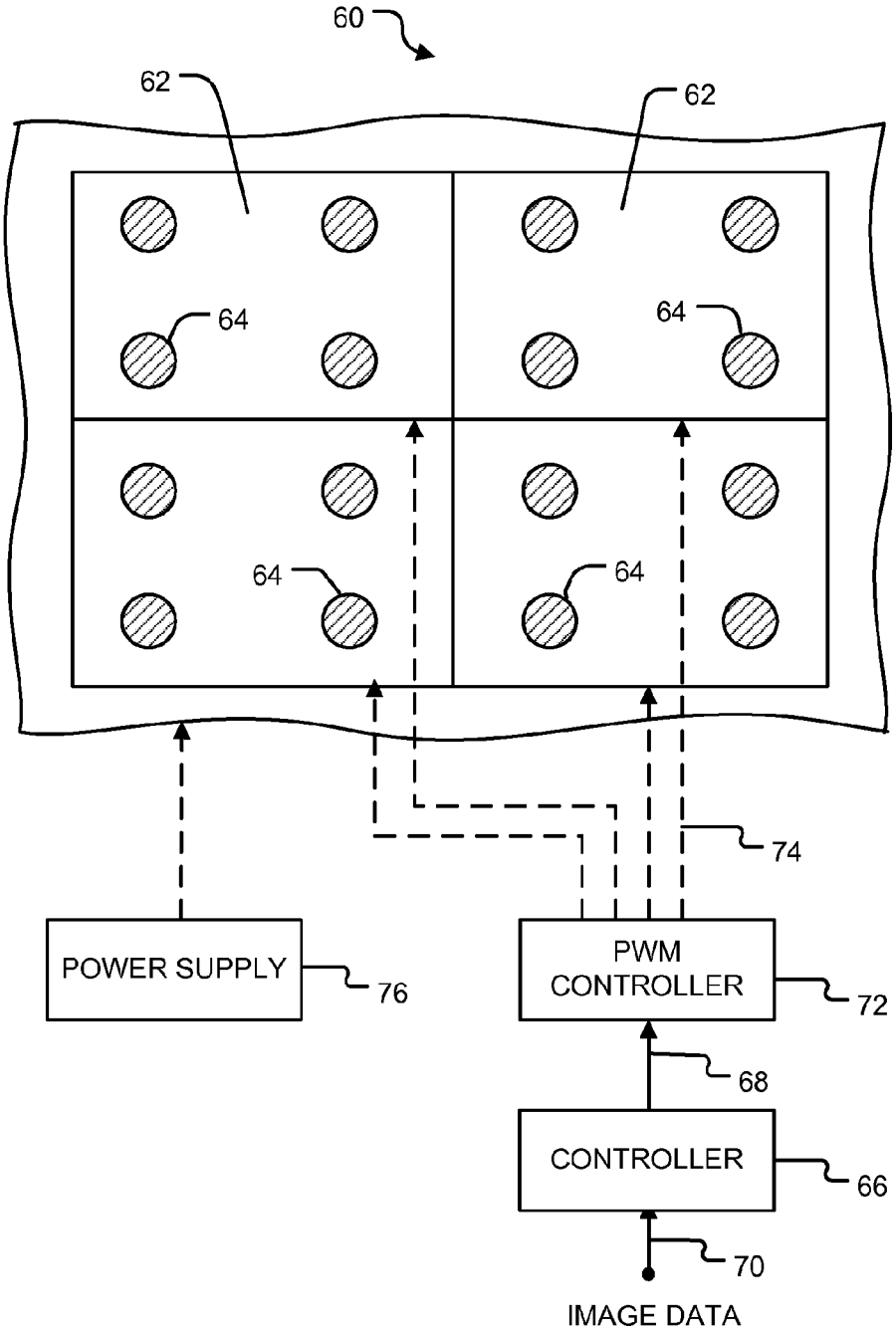
FIG. 5 is a schematic view of a backlight comprising tiles of light emitters according to an example embodiment of the present invention.

FIG. 5 illustrates a portion of a backlight 60 comprising multiple tiles 62 of light emitters 64 according to an example embodiment of the invention. Light emitters 64 may be LEDs for example. In some embodiments backlight 60 comprises a two-dimensional array of tiles 62 and each tile comprises a two-dimensional arrangement of light emitters 64. In some embodiments each tile 62 comprises a printed circuit board (PCB) comprising an array of LEDs or other light emitters.

A display incorporating backlight 60 may also comprise a controller 66 that generates brightness signals 68 according to input image data 70. Brightness signals 68 may be analog or digital signals representing the desired brightness level for one or more light emitters 64. Backlight 60 may also comprise one or more PWM controllers 72 for converting brightness signals 68 into PWM driving signals 74, which may directly control the brightness of light emitters 64. In some embodiments, backlight 60 comprises multiple PWM controllers 72, each controlling multiple light emitters 64 such as LEDs. In some embodiments, each tile 62 comprises one or more PWM controllers 72 for controlling light emitters 64 on that tile. For example, tiles 62 comprise PCBs having PWM controllers 72 integrated therein for controlling light emitters 64 on that PCB. Controller 66 and PWM controller 72 may be separate physical devices or may be combined within the same physical device.

PWM driving signals 74 may be waveforms comprising a sequence of cycles having a given duration, duty cycle and phase offset. PWM driving signals 74 may operate to switch on and off a fixed electrical current through a light emitter 64. In some embodiments, PWM driving signals 74 of one tile are phase shifted relative to PWM driving signals 74 of another tile (as illustrated for example in FIG. 3). In some embodiments, the duration of the first PWM cycle of an image displayed is longer than the duration of subsequent PWM cycles of the same image (as illustrated for example in FIG. 4B).

In the illustrated embodiment, PWM controller 72 outputs multiple PWM driving signals 74 that each control a separate tile 62. In some embodiments, all light emitters 64 on a tile 62 are controlled by a common PWM driving signal 74 generated for that tile. In other embodiments, duty cycles of PWM driving signals 74 for each light emitter 64 are independently controllable by one or more PWM controllers 72.

In some embodiments a controller chip or circuit individually controls multiple light emitters. In some embodiments the PWM controller chip or circuit is configured so that start times of the PWM signals generated for the light emitters are staggered relative to one another. In a backlight constructed using such PWM controller chip or circuits the times at which different groups of light emitters are turned ON are automatically staggered.

Backlight 60 also comprises a power supply 76 for providing electrical power to light emitters 64 on the backlight. Power supply 76 may be configured to satisfy particular power requirements necessary to generate the desired range of brightness of light emitters 64. Such power requirements may include load regulation, transient response and/or surge capacity for example. If the start time of groups of PWM signals are staggered as illustrated in FIG. 3 or 4, light emitters 64 are not all switched on to 100% brightness at the same time and such power requirements may be reduced as described above. In particular, in some embodiments, power supply 76 has a surge capacity that is less than the surge capacity that would be required if all light emitters 64 were switched on at the same time. The percentage reduction in surge capacity of power supply 76 may be proportional to the percentage reduction in the number of light emitters driven by PWM signals having the same phase offset. In some embodiments, power supply 76 has a maximum surge capacity less than half the surge capacity that would be required if all light emitters 64 were switched on at the same time.

Similarly, in some embodiments power supply 76 is capable of a maximum output surge current (out-rush current) that is less than the total in-rush current that would be required by light emitters 64 if all light emitters 64 were switched on at the same time. For example, if backlight 60 comprises N light emitters and each light emitter requires an in-rush current of $I_{rush}$ when switched on, then power supply 76 may have a maximum out-rush current of less than $N(I_{rush})$ while being capable of supplying the average current required. In some embodiments, power supply 76 has a maximum out-rush current less than $0.75(N)(I_{rush})$. In some embodiments, power supply 76 has a maximum out-rush current less than $0.5(N)(I_{rush})$.

Power supply 76 may be configured to have the capacity to supply a continuous output current sufficient to sustain a desired average brightness of backlight 60. In some embodiments, power supply 76 is capable of generating a maximum average light intensity over the entire backlight 60 that is less than localized light intensities it may generate over portions of backlight 60. For example, power supply 76 may be capable of generating localized light intensities of 2000 cd/m$^2$ or more over portions of backlight 60 while only capable of generating a maximum average light intensity of 400 cd/m$^2$ over the entire backlight 60.

Figure 6:
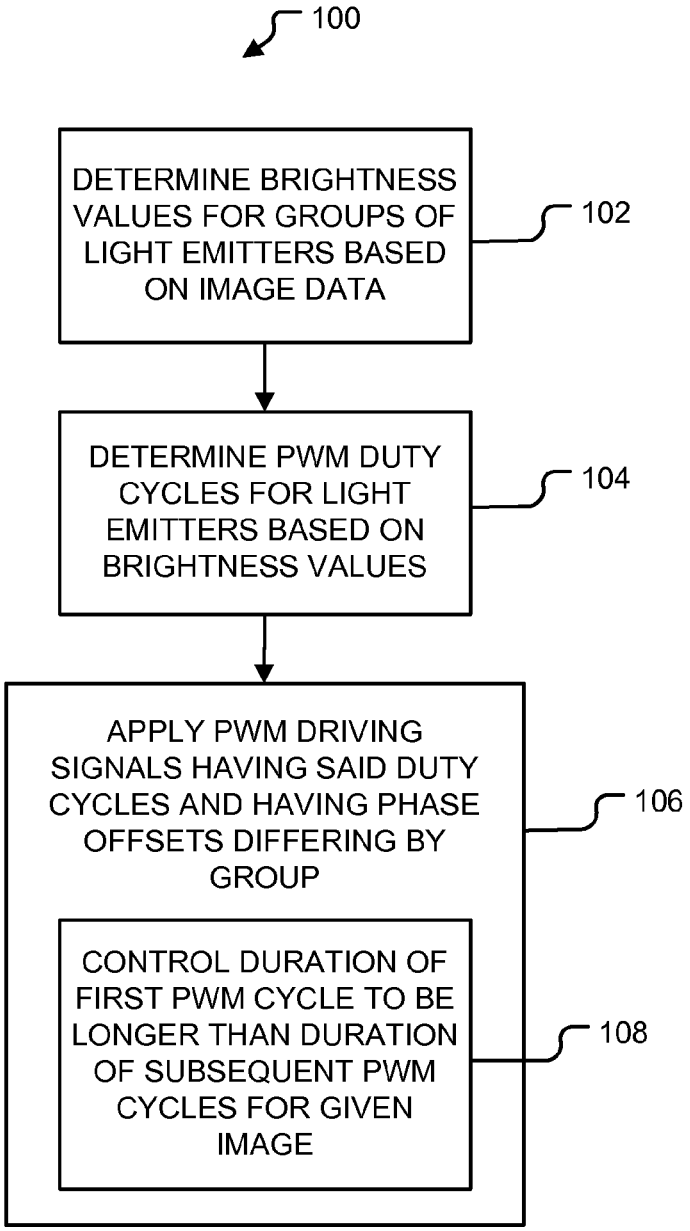
FIG. 6 is a flowchart illustrating a method according to an example embodiment of the present invention.

FIG. 6 illustrates a method 100 of generating PWM signals to drive groups of light emitters on a backlight to display an image according to an example embodiment of the present invention. Method 100 may be implemented in one or more controllers for a backlight for example.

Block 102 of method 100 involves determining brightness values for all light emitters on a backlight of a display based on image data representing an image to be displayed. In this method, the light emitters are divided into a plurality of groups. The brightness values may be determined independently for each separate light emitter or for each separate group so that the intensity of light emitted by the backlight and incident on a spatial light modulator can be made to vary in a desired way over the spatial light modulator. The brightness values may be represented by electronic analog or digital signals, for example.

At block 104 of method 100, PWM duty cycles are determined for the light emitters of each group based on the brightness values determined at block 102. The duty cycles may be expressed for example as the percentage or ratio of each PWM period that the light emitter should be in an ON state to produce the desired brightness level.

At block 106 of method 100, PWM driving signals having the duty cycle determined at block 104 and a phase offset predetermined for each group are generated and applied to each light emitter. The phase offsets applied for each group differ from one another so as to stagger the start times of PWM cycles of different groups (as illustrated in FIG. 3). For example, phase offsets for each group may be applied in increments of 360/N where N is the number of groups.

At block 108, the duration of each PWM cycle is set such that a first PWM cycle of the image is longer than duration of subsequent PWM cycles for the given image (as is illustrated in FIG. 4B). For example, the first PWM cycle may be made to be twice as long as subsequent PWM cycles. One benefit of extending the first cycle is to extend the ramp-up time required for the power and current drawn by the light emitters.

Figure 7:
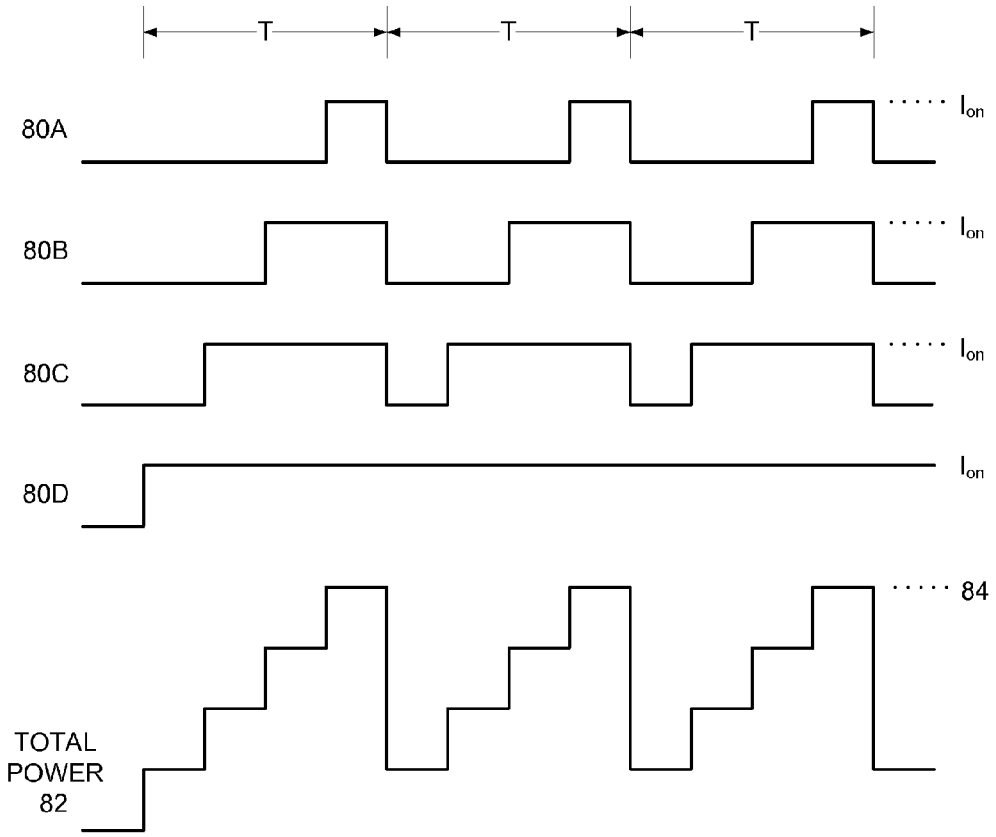
FIG. 7 is a waveform diagram illustrating PWM driving signals according to an alternative embodiment of the present invention.

It is not necessary that a PWM cycle always comprise a contiguous on-time portion followed by a contiguous off-time portion. For a given duty cycle, the pattern of on-time and off-time may varied so long as the overall ratio of on-time to off-time within the cycle is maintained. For example, the order of on-time and off-time within a cycle may be reversed such that a light emitter remains off for some first portion of the cycle and then turns on for the remaining portion of the cycle. In this case, light emitters having different brightness levels may turn on at different times within the same PWM cycle (and switch off at the same time at the end of the cycle). FIG. 7 illustrates four waveforms 80A-80D representing PWM signals having duty cycles of 25%, 50%, 75% and 100% respectively and a period T, wherein the on-time of each period follows the off-time. As illustrated in FIG. 7, the resulting total power waveform 82 steps up to a maximum value 84 during each cycle rather than rising instantaneously to the maximum value at the start of each cycle.

As another example, on-time may also be centered within a PWM cycle such that different power levels rise and fall at different times. On-time and off-time may be interspersed within a PWM cycle in any other chosen manner so long as the overall proportion of on-time to off-time within the cycle remains the same. Where a discrete number of brightness levels are defined for light emitters of the display (for example $2^n$ brightness levels where n is a number of bits defining brightness), each cycle may be divided into that number of segments (for example $2^n$ segments) during which a light emitter may be set ON or OFF. Each brightness level may correspond to a particular pattern of ON/OFF segments within a PWM cycle. Different groups of light emitters may employ different sets of ON/OFF patterns for each brightness level such that on-times between groups are staggered even if set to the same brightness level. The total power requirements may thus be distributed more evenly across PWM cycles.

Variations in the distribution of on-time and off-time within PWM cycles may be combined with variations in phase offsets for groups of PWM signals as described above. For example, the start times of individual light emitters within a group having a common phase offset may be staggered by measuring duty cycles from the end of each PWM cycle. If the duration of the first cycle of each new image is made longer than a default PWM period, the initial ramp-up time required may be correspondingly extended as well.

Figure 8:
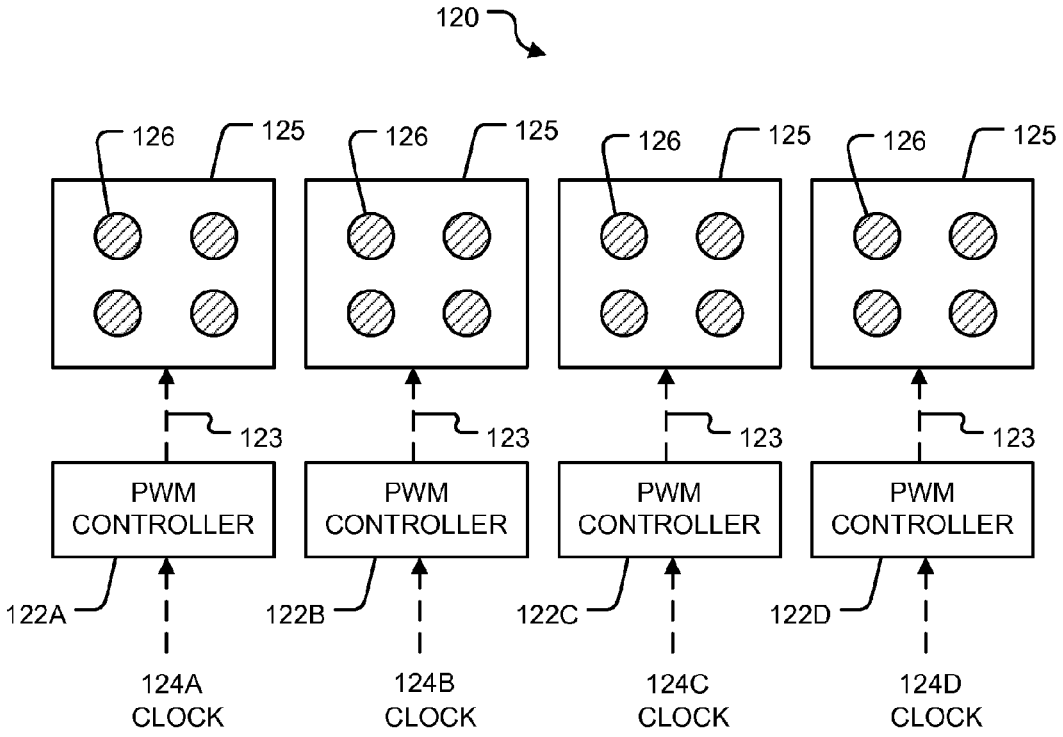
FIG. 8 is a schematic view of a backlight according to an alternative embodiment of the present invention.

FIG. 8 illustrates a backlight 120 according to another embodiment. In this embodiment, multiple PWM controllers 122A-122D (collectively PWM controllers 122) are each controlled by a separate clock signal 124A-124D (collectively clock signals 124). PWM controllers 122 each generate PWM driving signals 123 for a group 125 of one or more light emitters 126. Clock signals 124 have a common period T but are phase shifted from one another such that the start times of PWM cycles generated by PWM controllers 122 are staggered. Clock signals 124 may be generated by phase shifting the output of a common source clock by different amounts. For example, in the illustrated example depicting four PWM controllers, clock signal 124A may be phase shifted by 0, clock signal 124B may be phase shifted by 90, clock signal 124C may be phase shifted by 180 and clock signal 124D may be phase shifted by 270. In another example embodiment, a clock signal to one or more PWM controllers is inverted relative to the clock signal to one or more other PWM controllers.

In some embodiments, each clock signal 124 may be switched between a first clock signal used for the first PWM cycle of a displayed image and a second clock signal used for subsequent PWM cycles of the same image. The first clock signal may have a longer period than the corresponding second clock signal (for example a period of 2T compared to T), but the same phase offset. The first clock signal may thus be used to extend the duration of the first PWM cycle of each displayed image relative to the duration of subsequent PWM cycles of the same image. In alternative embodiments the frequency of a clock signal may be changed such that a period of a first PWM cycle is longer than that of subsequent PWM cycles.

In some embodiments, driving signals of multiple PWM controllers are time multiplexed within a period T such that different groups of light emitters are driven for different non-overlapping time intervals within a period T. In this way, the on-times of light emitters driven by different PWM controllers never overlap and thus the power requirements of the backlight are reduced.

Figure 9A:
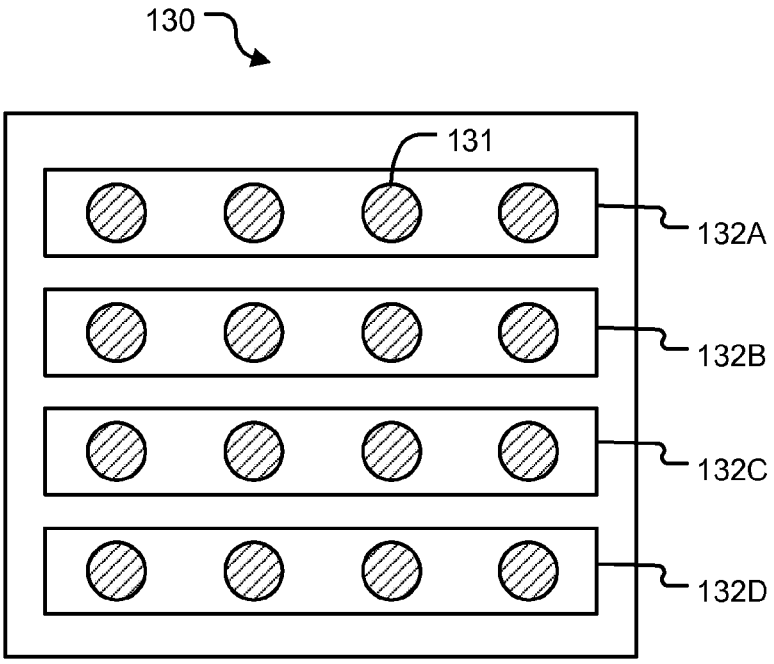
FIGS. 9A through 9C show example ways that different groups of light emitters may be arranged in an array in a backlight.
Figure 9B:
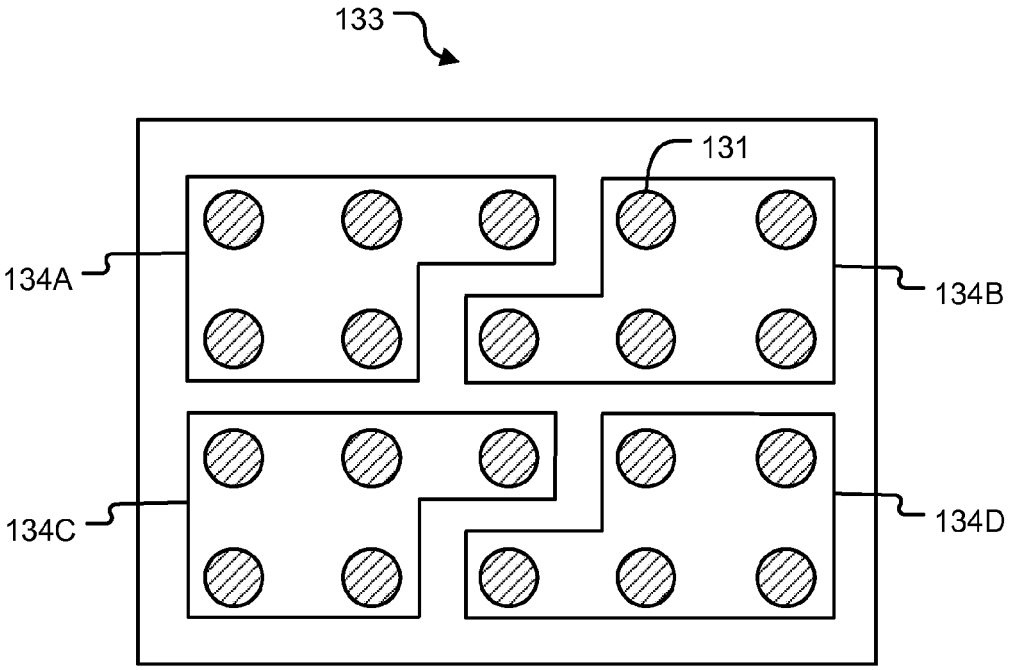
Figure 9C:
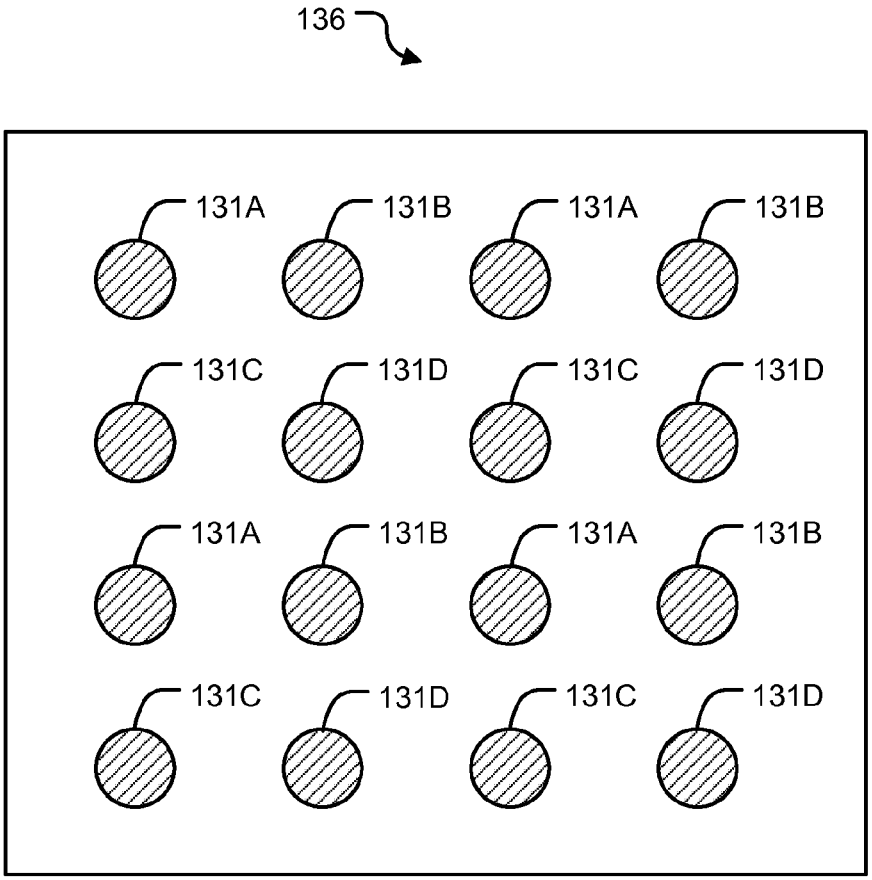

FIGS. 9A to 9C illustrate some ways in which different groups of light emitters may be made to correspond to different areas on a backlight. For example, in FIG. 9A a backlight 130 comprises a two-dimensional array of light emitters. Light emitters corresponding to horizontal strips 132A to 132D (collectively strips 132) are each controlled as a group such that the PWM start times of light emitters 131 in each strip 132 are staggered relative to PWM start times of light emitters 131 in other strips 132. Each strip 132 may comprise one or more rows of light emitters 131.

FIG. 9B shows another embodiment of a backlight 133 in which light emitters within blocks 134A to 134D (collectively blocks 134) are each controlled as group. Again, the PWM start times may be different for each group. FIG. 9C shows another embodiment of a backlight 136 where groups of light emitters having different PWM start times are interspersed. In this case, light emitters 131A are controlled to have their PWM cycles start simultaneously at a time that is staggered relative to the PWM start times of the other groups (illustrated as 131B, 131C and 131D).

Certain implementations of the invention comprise computer processors which execute software instructions which cause the processors to perform a method of the invention. For example, one or more processors in a control system for a display may implement the method of FIG. 6 or other methods as described herein by executing software instructions in a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, EPROMs, EEPROMs, flash RAM, or the like. The computer-readable signals on the program product may optionally be compressed or encrypted.

Where a component (e.g. a controller, processor, assembly, device, etc.) is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments of the invention.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A backlight for a display, the backlight comprising:

a plurality of groups of light emitters, each group comprising at least one light emitter;

a power supply, the power supply configured to supply power to the groups of light emitters; and one or more controllers, the controllers configured to receive a new set of image data to render upon the display and control brightness levels of the light emitters within the groups by applying pulse width modulation (PWM) driving signals to each light emitter, each PWM driving signals having an initial period, a duty cycle proportional to the brightness level, and a phase offset that varies between the groups;

wherein the brightness levels depend upon the received new image data and wherein the brightness levels of at least two light emitters are independently controllable;

wherein the duration of a first PWM cycle of the PWM driving signals for the new image is controllable to be different from the duration of subsequent PWM cycles for the new image;

wherein the duration of the first and subsequent PWM cycles are derived from image data so as to illuminate a primary modulator with a low resolution version of an image represented by the image data; and further wherein the total power of the backlight is configured to be ramped up from zero to a desired value for the first PWM cycle and fluctuate for subsequent PWM cycles for the new image to be displayed.

2. A backlight according to claim 1 wherein the phase offsets associated with each group are configurable to differ by increments of 360/N where N is the number of groups of light emitters.

3. A backlight according to claim 2 wherein each tile comprises a printed circuit board.

4. A backlight according to claim 1 wherein each group comprises a tile comprising an array of light emitters.

5. The backlight according to claim 1, wherein the light emitters comprise individually controllable narrowband light sources and wherein the backlight is configured to illuminate a spatial light modulator and installed in a cinema system comprising a controller configured to energize the backlight and the spatial light modulator based on image data.

6. The backlight according to claim 5, wherein the narrowband light sources comprise red, green, and blue LEDs.

7. A method for controlling light emitters of a backlight, the method comprising:

determining brightness values for groups of the light emitters based on received image data representing a new image to be displayed;

determining first and subsequent PWM duty cycles for the groups of light emitters based on the brightness values;

applying PWM driving signals having the determined first and subsequent duty cycles and having phase offsets that are different for each group to the light emitters;

wherein a duration of a first PWM cycle of the PWM driving signals for the image is longer than the duration of subsequent PWM cycles for the image;

wherein the duration of the first and subsequent PWM cycles are derived from image data so as to illuminate a primary modulator with a low resolution version of an image represented by the image data; and further wherein the total power of the backlight is configured to be ramped up from zero to a desired value for the first PWM cycle and fluctuate for subsequent PWM cycles for the new image to be displayed.

8. A method according to claim 7 wherein each PWM cycle of the applied PWM driving signals comprises a first percentage of time that corresponds to the duty cycle in an ON state preceding a remaining percentage of time in an OFF state.

9. A method according to claim 8 wherein each PWM cycle of the applied PWM driving signals comprises a first percentage of time in an OFF state preceding a remaining percentage of time that corresponds to the duty cycle in an ON state.

10. The method according to claim 7, wherein the light emitters comprise individually controllable narrowband light sources and wherein the backlight is configured to illuminate a spatial light modulator and installed in a cinema system comprising a controller configured to energize the backlight and the spatial light modulator based on image data.

11. A backlight comprising a plurality of light emitters and a power supply, the power supply having a maximum power surge capacity that is less than a combined current draw of all of the light emitters of the backlight, and wherein a controller receives a set of image data for a new image to be rendered upon a display and causes the plurality of light emitters to provide an illumination comprising a low resolution of an image according to image data for the new image;

wherein the duration of the first and subsequent PWM cycles of the plurality of light emitters are derived from image data for the new image so as to illuminate a primary modulator with a low resolution version of an image represented by the image data; and further wherein the total power of the backlight is configured to be ramped up from zero to a desired value for the first PWM cycle and fluctuate for subsequent PWM cycles for the new image to be displayed.

12. A display comprising N light emitters, each of the light emitters, when driven by a controller, the controller configured to receive a set of image data for a new image to be rendered upon the display, drawing an in-rush current A, and a power supply connected to supply electrical power to the N light emitters, the power supply having a maximum out-rush current M where M<(N)(A), and wherein the controller sends signals driving the light emitters to produce a light pattern comprising a low resolution version of an image to be displayed; and wherein the duration of a first and subsequent PWM cycles of the N light emitters are derived from the image data for the new image so as to illuminate a primary modulator with a low resolution version of an image represented by the image data; and further wherein the total power of the backlight is configured to be ramped up from zero to a desired value for the first PWM cycle and fluctuate for subsequent PWM cycles for the new image to be displayed.

13. A display according to claim 12 wherein M<0.75(N)(A).

14. A display according to claim 12 wherein M<0.5(N)(A).

15. A display comprising:

a spatial light modulator;

a backlight comprising a plurality of groups of light emitters for illuminating the spatial light modulator, each group comprising at least one light emitter;

a power supply, the power supply configured to supply power to the groups of light emitters; and one or more controllers, the controllers configured to receive a set of image data for a new image to be rendered upon a display and control brightness levels of the light emitters within the groups by applying pulse width modulation (PWM) driving signals to each light emitter, the PWM driving signals having, a duty cycle proportional to the brightness level, wherein the one or more controllers are configured to apply a different phase offset to the PWM driving signals for the light emitters of each of the groups;

wherein the brightness levels depend upon received image data representing the new image to be displayed and wherein the brightness levels of at least two light emitters are independently controllable;

wherein a duration of a first PWM cycle of the PWM driving signals for the new image is controllable to be different from subsequent PWM cycles for the new image;

wherein the one or more controllers configured to cause the plurality of groups of light emitters to emit a low resolution version of the new image;

wherein the duration of the first and subsequent PWM cycles of the plurality of groups of light emitters are derived from image data so as to illuminate a primary modulator with a low resolution version of the new image; and further wherein the total power of the backlight is configured to be ramped up from zero to a desired value for the first PWM cycle and fluctuate for subsequent PWM cycles for the new image to be displayed.

16. The display according to claim 15, wherein the light emitters comprise individually controllable narrowband light sources and wherein the backlight is configured to illuminate a spatial light modulator and installed in a cinema system comprising a controller configured to energize the backlight and the spatial light modulator based on image data.

17. A lighting apparatus comprising a plurality of PWM driving circuits, each PWM driving circuit configured to generate PWM signals to drive one or more light emitters, wherein the PWM signals of each PWM driving circuit are configured to have a different phase offset; and wherein the PWM signals are configured to drive the light emitters to emit a low resolution version of a new image to be displayed;

wherein the duration of the first and subsequent PWM cycles of the plurality of driving circuits are derived from image data of the new image so as to illuminate a primary modulator with a low resolution version of an image represented by the image data; and further wherein the total power of the backlight is configured to be ramped up from zero to a desired value for the first PWM cycle and fluctuate for subsequent PWM cycles for the new image to be displayed.

18. A lighting apparatus according to claim 17 wherein the phase offset of each PWM driving circuit is controlled by a clock signal connected to the PWM driving circuit.

19. A lighting apparatus comprising a plurality of PWM driving circuits, each PWM driving circuit configured to generate PWM signals to drive one or more light emitters, wherein the PWM signals of each PWM driving circuit are configured to be time multiplexed and energize the light emitters so as to emit a pattern of light comprising a low resolution version of a new image to be displayed;

wherein the duration of the first and subsequent PWM cycles of the plurality of driving circuits are derived from image data of the new image so as to illuminate a primary modulator with a low resolution version of an image represented by the image data; and further wherein the total power of the backlight is configured to be ramped up from zero to a desired value for the first PWM cycle and fluctuate for subsequent PWM cycles for the new image to be displayed.

* * * * *